US006078263A

United States Patent [19]

Galloway, Jr.

[11] Patent Number: 6,078,263

[45] Date of Patent: Jun. 20, 2000

[54] METHOD AND APPARATUS FOR ENSURING SAFE OPERATION OF ELECTRIC OVERHEAD DOOR

[75] Inventor: John H. Galloway, Jr., Roseville, Mich.

[73] Assignee: RS Parts Distributors, Inc., Roseville, Mich.

[21] Appl. No.: 08/827,890

[22] Filed: Apr. 14, 1997

Related U.S. Application Data

[63] Continuation of application No. 08/607,266, Feb. 20, 1996, abandoned.

[51] Int. Cl.[7] ..... G08B 21/00

[52] U.S. Cl. ..... 340/679; 340/524; 340/664; 52/173.2; 318/265; 318/266; 318/469

[58] Field of Search ..... 340/679, 664, 340/693, 691, 692, 326, 524, 825.31, 487; 318/265, 266, 466, 469; 52/173.2

[56] References Cited

U.S. PATENT DOCUMENTS

| | | | |
|---|---|---|---|
| 3,424,961 | 1/1969 | Leehhouts | 318/696 |
| 3,426,829 | 2/1969 | McDaniel | 160/201 |
| 4,243,926 | 1/1981 | Phillips | 318/798 |
| 4,355,274 | 10/1982 | Bourbeau | 318/812 |
| 4,548,549 | 10/1985 | Murphy | 417/53 |
| 4,914,859 | 4/1990 | Gionet | 49/25 |
| 5,129,442 | 7/1992 | Warner | 160/271 |
| 5,222,009 | 6/1993 | Scharnick et al. | 361/28 |
| 5,228,492 | 7/1993 | Jou | 160/188 |
| 5,239,719 | 8/1993 | Ware | 8/152 |
| 5,284,325 | 2/1994 | Sasaki | 254/274 |
| 5,321,216 | 6/1994 | Jamieson | 187/280 |
| 5,404,088 | 4/1995 | Nanos | 318/751 |
| 5,408,789 | 4/1995 | Plfeger | 52/173.2 |
| 5,412,297 | 5/1995 | Clark | 318/468 |
| 5,512,883 | 4/1996 | Lane, Jr. | 340/648 |
| 5,685,987 | 11/1997 | Hixon, Jr. et al. | 210/636 |

*Primary Examiner*—Edward Lefkowitz
*Assistant Examiner*—Davetta Woods
*Attorney, Agent, or Firm*—Avery N. Goldstein

[57] ABSTRACT

The sudden unrolling of an motor driven overhead door is a hazardous occurrence. The invention provides a method of detection and warning of a damaged counterbalance mechanism or other defect in the door lifting assembly. The amperage readings of the drive motor are observed to increase between 5% and 30%, above that of normal operation when the function of the counterbalance assembly or similar drive assembly component is compromised. The method is reduced to practice as a number of alternative electronic circuits which are placed between the line power source and the drive motor. The circuit senses the motor amperage draw and compares the reading with a preset threshold value. Upon the sensed value exceeding the threshold value, a warning is broadcast. This method alerts one of undue strain on a damaged lifting assembly prior to its catastrophic failure.

13 Claims, 4 Drawing Sheets

METHOD AND APPARATUS FOR ENSURING SAFE OPERATION OF ELECTRIC OVERHEAD DOOR

This is a continuation application claiming priority based on an original application filed Feb. 20, 1996 and assigned the Ser. No. 08/607,266, now abandoned.

FIELD OF THE INVENTION

The present invention pertains to the art of overhead rolling doors and more particularly to a method for providing warning of a malfunction in the lifting assembly of an electric motor-driven door.

BACKGROUND OF THE INVENTION

Overhead doors, as encountered in both commercial and residential settings represent a space-saving way of providing ingress into buildings. Overhead door is defined herein to include vertically rolling steel, sectional, countershutters, grilles, doors, as well as single section closures which retract and engage via a rolling track. Since the weight of such doors must be wholly displaced vertically, a counterweight is usually provided to lessen the work of operation. Counterbalancing mechanisms are typically employed in this role due to their compactness and high mechanical energy storage densities. Using dead weight as a counterbalance is often inefficient in that it occupies considerable space and has an appreciable travel distance.

The disadvantage of storing mechanical power within a mechanism is the loss of elastic compression with wear, resulting in a loss of counterbalancing ability. In the extreme case, the mechanism fails catastrophically leaving the unbalanced door load to be driven by a now overtaxed motor. The drive motor for overhead doors typically are connected to the rolling door spindle or track via gearing and a chain or belt drive. The diminished counterbalancing ability of a fatigued or broken mechanism burdens the chain drive and gear teeth with a greater load density per unit of weight-bearing area. This situation not only taxes the motor and all mechanical parts, but also leads to chain drive slippage, or failure and the possibility of the door free-falling in the course of operation.

Various methods for preventing the accidental unrolling of an overhead have been developed. These methods have generally been responsive to an excessive and unsafe falling speed of the door. Such excessive falling speeds induce a mechanical brake mechanisms to engage thereby limiting the descent of the door. The braking mechanisms have included bearing and inertial type systems. U.S. Pat. No. 4,848,522 is representative of such safety devices. Regardless of the specifics, currently used methods of preventing the accidental unrolling of overhead doors only respond to a catastrophic failure of the door lifting assembly whereby the door is in free fall. The engagement of this type of device, a stop lock bearing or inertial brake, locks the door from moving in either direction and, requires service when tripped to relieve the tension on the device for re-setting. The installation costs and service requirements are major factors in limiting the utility of these devices. There is no indication with these devices that such an event is imminent and upon preventing such a free fall, the door inevitably seizes at the point in its travel when the door dropping speed became excessive. Furthermore, should such a safety mechanism malfunction, harm is a genuine possibility.

It is an object of the invention to provide a warning that an uncontrolled door descent is imminent, thereby allowing for interdiction prior to door free fall.

SUMMARY OF THE INVENTION

The invention provides a method of detection and warning of a damaged counterbalance mechanism or other defect in the door lifting system that would result in an increase in drag on the electric drive motor. The invention rests on the observation of a correlation between amperage readings of the drive motor and the function of the counterbalance assembly. The drive motor is an alternating current (AC) motor which is powered by a source of AC, such as, but not limited to, a source of 60 Hz, 110 V or 50 Hz, 220V.

The invention utilizes a control panel which is capable of performing a series of process steps upon connection to the drive motor. The processes include:

- a sensing stage, wherein the current loading of the door drive motor is determined;
- a comparative stage which is coupled to the sensing stage, wherein the sensed amperage is compared to a preset warning threshold value; and
- a warning stage which alerts the human or computer operator of the condition that the sensed amperage exceeds the preset threshold value, indicating that the door requires repair in order to avoid a catastrophic failure.

DETAILED DESCRIPTION OF THE INVENTION

The present invention derives from the observation that as the counterbalancing mechanisms used in overhead doors fatigue, the drive motor current load increases from 5% to 30% above the base load of the motor necessary to operate such a door. The percentage increase in motor drag depends on the characteristics of the overhead door, including among other factors: the spring constant, door weight, gearing ratio, motor power rating and drive chain elasticity. A threshold for the current load on the drive motor for safe operation of the door is determined by measuring the motor amperage necessary to lift the counter-balanced weight of the door, plus an acceptable safety factor. The present invention functions to sense the actual motor loading, compare the sensed motor loading with the predetermined threshold and upon the sensed motor amperage value exceeding the threshold, a warning signal is conveyed to the operator. While in most cases a warning will take the form of a visual and or auditory signal to alert a human operator that the door drive system is being overtaxed; instances exist, such as in automated building operations, where a warning signal will consist of an electronic signal sent to a control computer.

Figure 1:
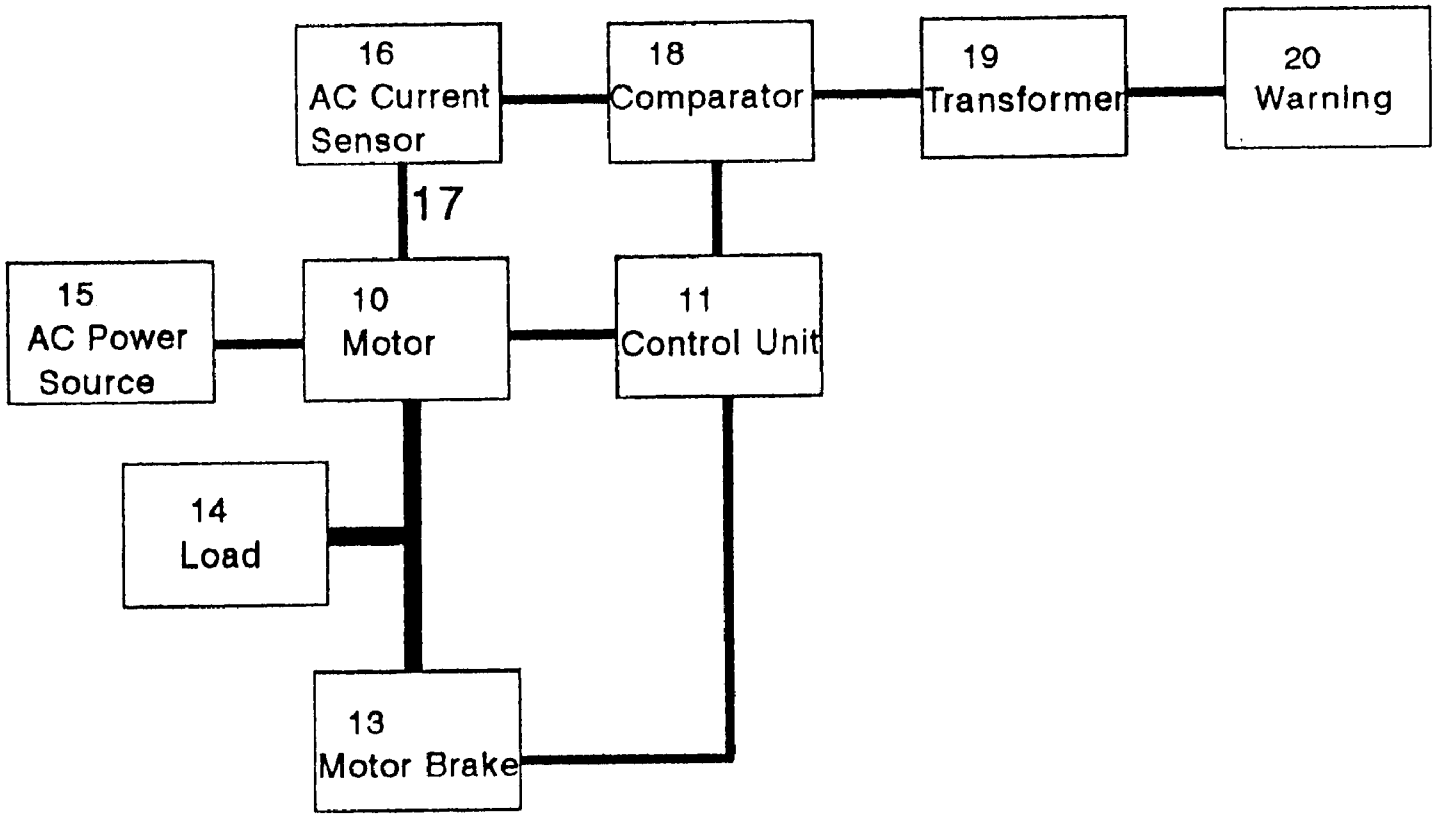
FIG. 1 is a block diagram of a system for electrically driving an overhead door which contains a warning system of the present type.

Referring to FIG. 1, the drive motor, 10 is operated by a motor control unit, 11. The motor control unit, 11 has at least "open", "close" and "stop" settings, the latter of which activates a brake mechanism, 13. The brake mechanism, 13 is also activated upon the door load (including the counterbalance), 14 reaching the extended or retracted limits of the travel. The windings of the motor, 10 are connected to an AC power source, 15 which deliver alternating current of, for example, 60 Hz, 110V or 50 Hz, 220V. This represents a standard overhead door operating configuration for illustrative purposes; variations on this configuration remain amenable to the deployment the invention to warn of door lifting assembly malfunction. The process detailed in the invention begins with an AC current sensor, 16 which is attached by leads, 17 to the drive motor, 10. The amperage reading form the motor, either in analog or digital form, is then coupled to a comparator circuit, 18. There are a number of electronic components which when placed in a suitable circuit configurations can act as current sensors and comparators. Circuits may be constructed to function based on relative capacitance, Wheatstone bridge-type resistive configurations, solid state transistors or Op Amps. Should the instantaneous amperage reading be less than the predetermined cut-off threshold, the control unit signal from 11 continues to operate the drive motor, 10; else, drive motor current is allowed to energize a transformer, 19 so as to change the voltage to for example, 24 V or 120 V in order to operate warning systems, 20. Stepping down the voltage to operate the warning system is a preferred function, but not essential to the operation of the invention.

One may configure the safety device so as to override the control unit signal in the event of an excessive current reading, thereby immediately stopping the door motion or alternatively, continue to allow the control unit signal to direct door operation, while the warning system remains active thereby requiring the operator to discern the appropriate maintenance procedure.

Figure 2:
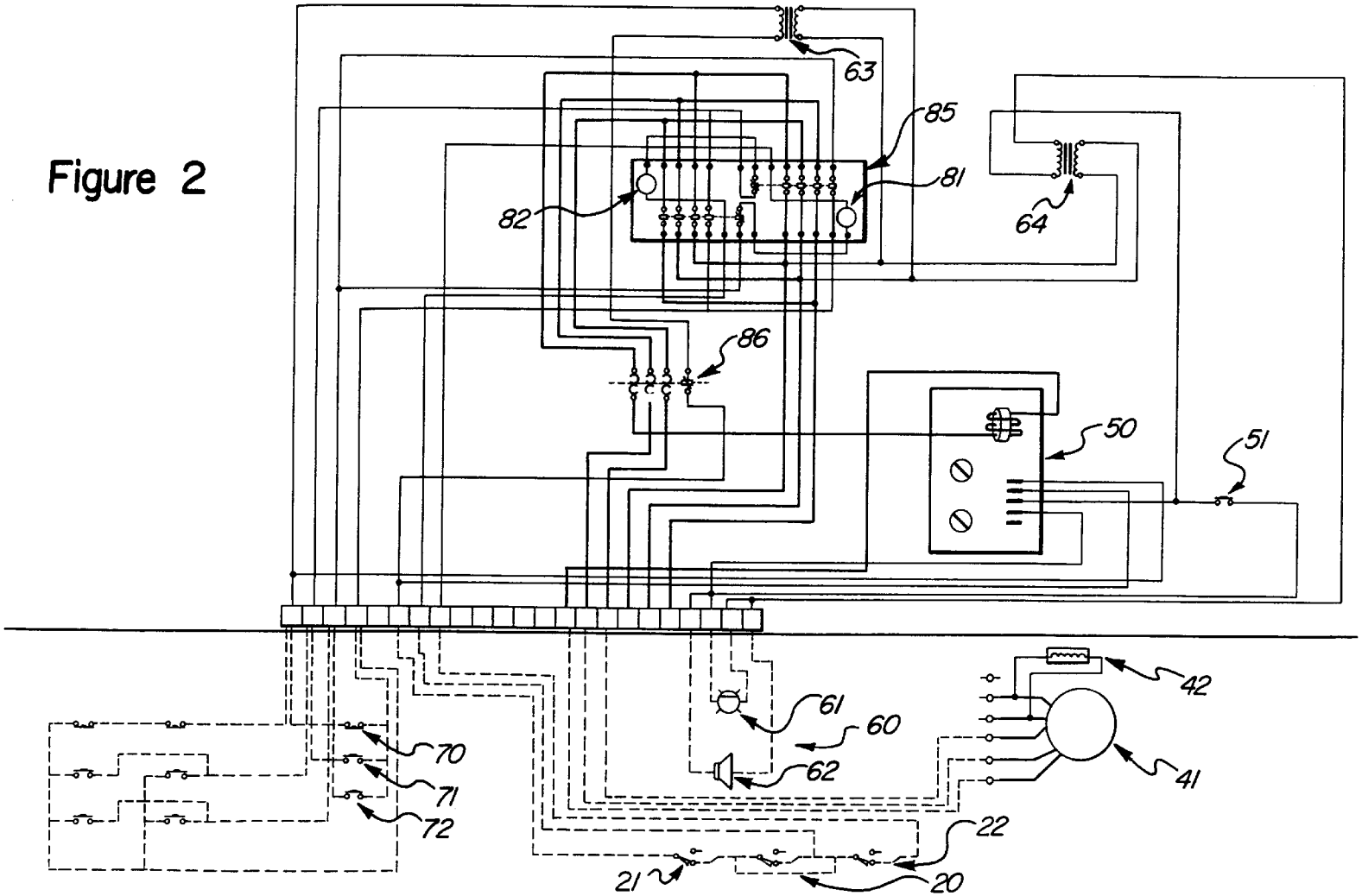
FIG. 2 is an electric schematic diagram of an embodiment of the present invention with portions of other circuits shown to illustrate relevant interconnections.

As shown in FIG. 2, representative control electronics incorporating monitoring of the current load on the drive motor, 41 are substantially formed from an AC current sensor, 50 and a warning system circuit, 60. Preferably, the AC current sensor is a standard commercially available unit, such as, for example the ECS series units produced by SSAC, Inc. of Baldwinsville, N.Y., USA. In this and like units, the sensed drive motor current generates a secondary current by means of a torroid. The threshold current setting serves to adjust a sub-circuit voltage which is compared to the voltage resulting from the secondary current. Alternatively, variants of standard current control circuits are operative, such as "an electronic fuse" described by R. Quong, *Electronics,* Sep. 15, 1977, pg. 117, which is incorporated herein by reference.

The warning system devices, 60 include a beacon light, 61 and a horn, 62, both of which operating at 120 V. The beacon light and speaker are representative of the warning devices that function in this invention and may be replaced with, for example a flashing signal and a buzzer, respectively. The warning system circuit, 60 can be operated at the same, or a different voltage relative to the remainder of the control panel circuit. When the warning system operates at a different voltage than the other portions of the control panel circuit, as shown in FIG. 2, separate transformers are required to supply the appropriate secondary voltage to the various portions of the circuit. It is a preferred embodiment of the invention that the warning system circuit, 60 and the control panel circuits operate at the same, and a lower voltage, as compared to the line voltage. Lower control panel voltages provide increased safety and reliability in this application.

In operating to open the door, the maximal demands are placed on the drive motor. The sequence of opening the door begins with activating one of a possible multiplicity of "open" push button switches, 71. As a result, a coil, 82, operating at 24 V and thereby the drive motor, 41 are energized, continuing the lifting of the load. The door motion is normally terminated by activating the "stop" push button, 70, thereby stopping the motor, 41 and if so required activating the motor brake, 42. However, open limit switch, 20 serves to prevent excessive wear on the drive system by limiting the motor operation to the travel limits of the door, through an interlock switch, 21 should the normal stop mechanism be bypassed. A similar switch, 22 prevents exceeding the door travel upon closing. The travel limiting, and push button switches are a preferred external wiring options to the control panel circuit and as such, are designated schematically by dashed wiring lines.

The drive motor amperage draw from the power lines is detected by the AC current sensor, 50 via relay contacts collectively designated, 85. Thermal overload connections, 86 separate the line power from the motor and further serve to protect the overhead door drive motor from excessive power draw. A line signal is monitored via inputs 1 and 2 of the ECS series AC current sensor. When the monitored current exceeds a preset current threshold, output contacts 3 and 4 of the AC current sensor, 50 close, activating the warning circuit, 60. Line power energizes the step down transformers, 63 and 64 which supplies 24 V and 120 V current, respectively to those portions of the control panel electronics circuit which operate at these voltages. A "test" push button, 51 is provided to assure the warning system is functioning properly.

Upon activating the "close" push button, 72, a similar 24 V coil, 81 is activated, amperage sensing, comparing and warning steps are operative in the electronic control circuit, as shown in FIG. 2. However, since the maximal drag on the motor is experienced upon lifting the load (opening the door) the use of the circuit in this mode to serve as a warning system is of secondary importance. One may modify the representative electronic control circuit, so as to only allow downward travel of the door load upon activation of the warning system, 60 or to insert circuit breakers, for example without departing from the inventive concept disclosed herein.

Figure 3:
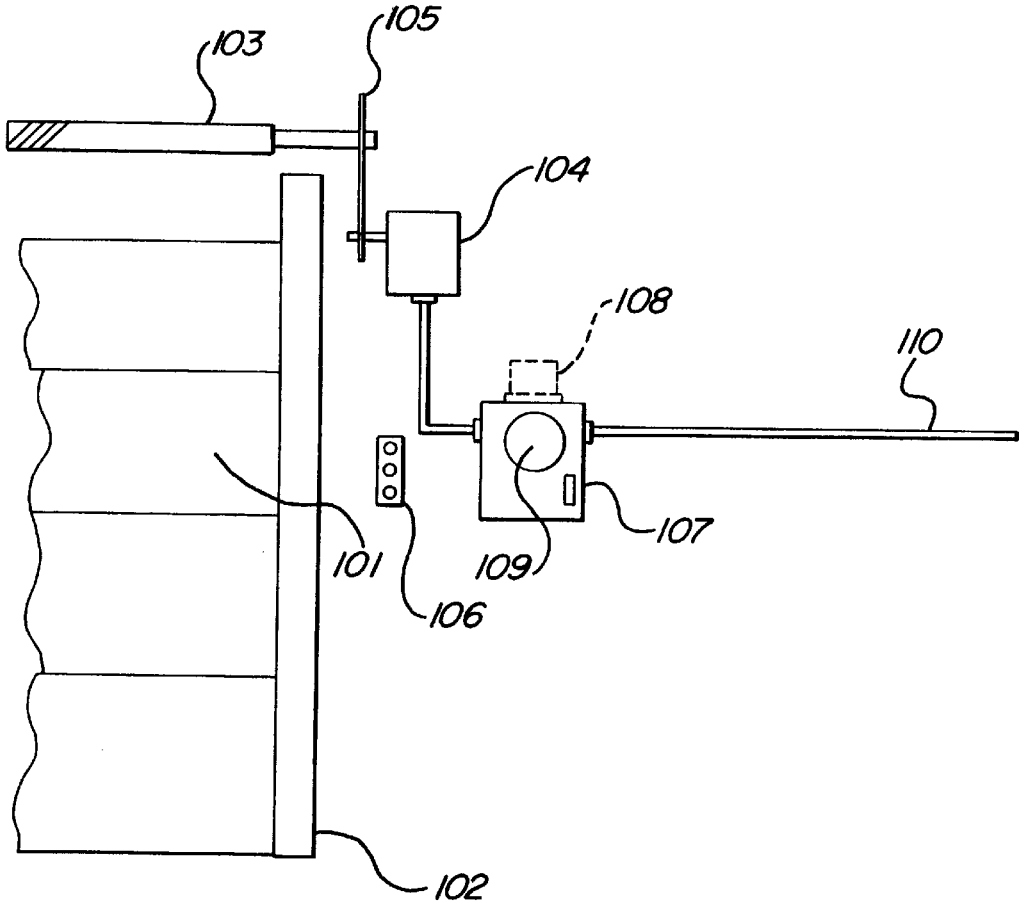
FIG. 3 is a drawing showing the position of various components of an electrically operated overhead door and the relative location of device to perform the present invention. The scale of the various components is modified for clarity.

FIG. 3 depicts an installation of a controller warning circuit as depicted in FIG. 2 relative to the components of an overhead door. The door, 101 is guided in its travel by side jamb tracks, 102. A counterbalance mechanism assembly, 103 interconnects the apical section of the door to a drive motor/gearing reducer operator, 104 via a belt or chain drive, 105. The motor push button switch station, 106 consisting of at least open-close-stop commands is wall-mounted and interconnects the drive motor, 104 and the wall-mounted controller warning circuit, within its housing, 107. The housing, 107, integrates an external warning beacon, 108 and an internal speaker, 109. The controller warning circuit housing, 107 is interposed between the motor, 104 and the electrical service wiring, 110 thereby allowing for the disengagement of the motor upon the amperage draw exceeding the pre-determined threshold.

Figure 4:
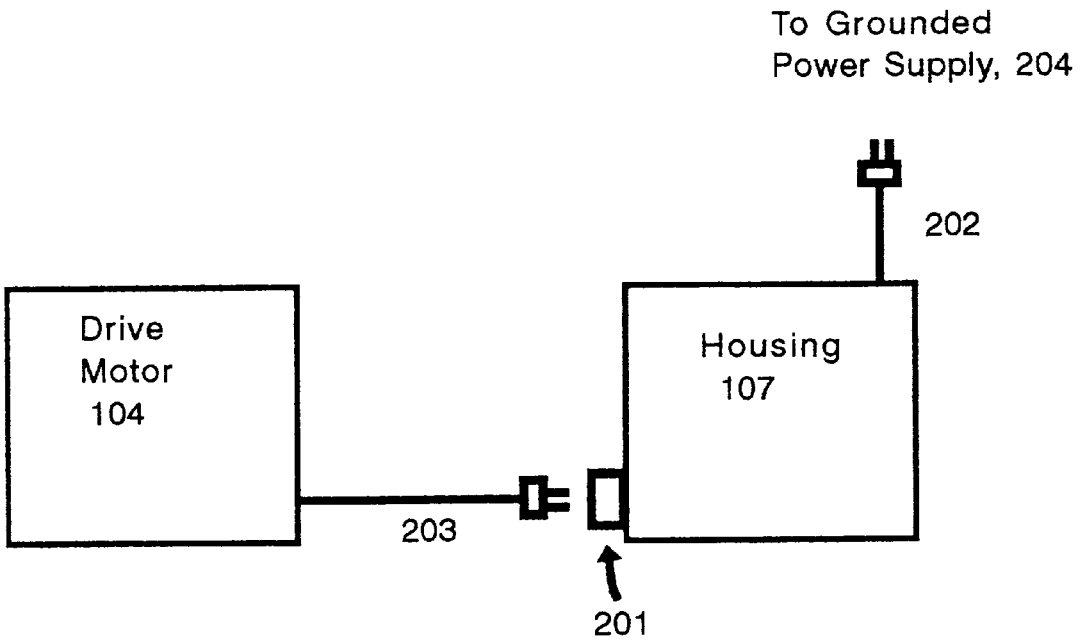
FIG. 4 is a drawing illustrating a means for retrofitting overhead doors with a device to perform the invention.

In an embodiment of the invention suited to retrofit installation on both commercial and residential doors, the control panel circuit housing is equipped with a single duplex plug, 201 and a pigtail powercord, 202, FIG. 4. The pigtail lead, 203 from the motor, 104 inserts into the single duplex plug, 201. The pigtail extending from the control panel circuit housing, 107 connects to a suitable grounded power supply, 204. A means for mounting or otherwise securing the control panel circuit housing is also provided.

It is understood that the invention is not limited to the specific descriptions above, which are intended to provide illustrative, working examples that encompass the inventive concept. Various elements may be substituted within such a control panel warning circuit without departing from the spirit and scope of the invention as defined in the following claims.

What is claimed is:

1. An overhead door system driven by an electric motor and using a counterbalancing mechanical spring to partially offset the load of the door, wherein the improvement comprises: a unit for indirectly checking the mechanical spring counterbalancing ability during operation of the door and prior to a greater than 20% decrease in said spring counterbalancing ability over the course of a single door operation cycle, by sensing the amperage draw of said electric motor and comparing the amperage draw to a preselected value, wherein said unit is placed in a wall-mountable enclosure.

2. An apparatus for lifting an overhead door and warning of a malfunction therein comprising:

an overhead door having an apical section;

an electric motor for lifting said door;

a counterbalancing mechanism assembly interconnecting the apical section of said door and said drive motor, said assembly being able to counterbalance the weight of said door; and a warning circuit for indirectly checking the mechanical spring counterbalancing ability during operation of said door by sensing an amperage draw of said electric motor and comparing the amperage draw to a preselected value.

3. The apparatus of claim 2 further comprising a wall mounted enclosure for housing said unit.

4. The apparatus of claim 2 further comprising a warning system activated in response to the amperage draw of said motor exceeding the preselected threshold.

5. The apparatus of claim 2 wherein said warning system is selected from the group consisting of: a beacon light and an auditory speaker.

6. The apparatus of claim 2 wherein said amperage threshold is between 5% and 30% greater than a base amperage draw of said drive motor.

7. The apparatus of claim 2 wherein said amperage threshold is between 10% and 20% greater than the base amperage draw of said drive motor.

8. An apparatus for warning of a malfunction in a door comprising:

an electrical circuit for sensing an amperage draw of an electrical drive motor operating said door, a counterbalancing mechanism assembly interconnecting the apical section of said door and said drive motor, said assembly being able to counterbalance the weight of said door, and activating a warning system upon the amperage draw exceeding a preselected value during operation of said door.

9. The apparatus of claim 8 wherein said warning system is a beacon light.

10. The apparatus of claim 8 wherein said warning system is an auditory speaker.

11. The apparatus of claim 8 wherein the preselected value is between 5% and 30% greater than a base amperage draw of said drive motor.

12. The apparatus of claim 8 wherein said amperage threshold is between 10% and 20% greater than the base amperage draw of said drive motor.

13. The apparatus of claim 8 further comprising a power shutoff circuit to said drive motor coupled to said electrical circuit.

* * * * *